US007389549B2

(12) United States Patent
Vierkant, III

(10) Patent No.: US 7,389,549 B2
(45) Date of Patent: Jun. 24, 2008

(54) QUICK RELEASE TOILET SEAT HINGE ASSEMBLY

(75) Inventor: Erich C. Vierkant, III, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 313 days.

(21) Appl. No.: 10/949,131

(22) Filed: Sep. 24, 2004

(65) Prior Publication Data

US 2006/0064807 A1 Mar. 30, 2006

(51) Int. Cl.
*A47K 13/12* (2006.01)

(52) U.S. Cl. ..... 4/236; 4/240

(58) Field of Classification Search ..... 4/236, 4/240

See application file for complete search history.

(56) References Cited

U.S. PATENT DOCUMENTS

| | | | | |
|---|---|---|---|---|
| 4,159,548 | A | 7/1979 | Hewson | |
| 4,326,307 | A | 4/1982 | Baillie et al. | |
| 4,939,796 | A | 7/1990 | Pepper | |
| 4,965,889 | A | 10/1990 | Tissot et al. | |
| 5,175,891 | A * | 1/1993 | Ohshima et al. | 4/236 |
| 5,933,875 | A | 8/1999 | Hulsebus et al. | |
| 5,980,150 | A | 11/1999 | Newman et al. | |
| 6,052,869 | A | 4/2000 | Suzuki | |
| 6,070,295 | A | 6/2000 | Hulsebus | |
| 6,381,762 | B1 | 5/2002 | Moser | |
| 6,807,686 | B1 * | 10/2004 | Janes | 4/234 |

FOREIGN PATENT DOCUMENTS

| | | |
|---|---|---|
| FR | 2703579 | 10/1994 |
| GB | 2 280 219 | 1/1995 |
| JP | 10-258003 | 9/1998 |
| JP | 10-258003 | 12/1998 |

* cited by examiner

*Primary Examiner*—Charles E. Phillips
(74) *Attorney, Agent, or Firm*—Quarles & Brady LLP

(57) ABSTRACT

Disclosed is a hinge assembly for connecting a toilet seat and cover to a rearward extension behind a toilet bowl. Two base members are permanently affixed to the extension in spaced fashion. Two hinge support members are provided to snap connect to the base members by virtue of flexible tabs on the base members interconnecting with side wall holes on the hinge supports. The hinge supports, seat and cover can be removed from the extension by squeezing the sides of the hinge support members, leaving only the bases attached to the extension. This facilitates cleaning.

10 Claims, 8 Drawing Sheets

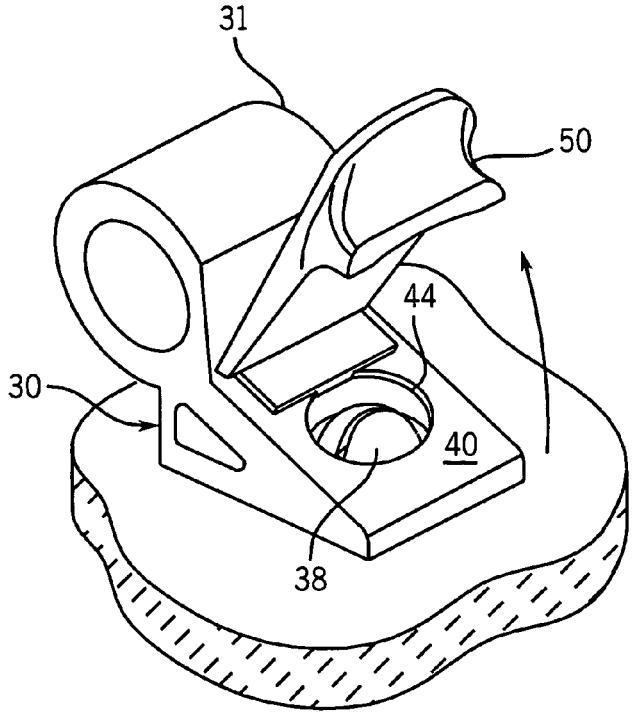
FIG. 6
FIG. 7
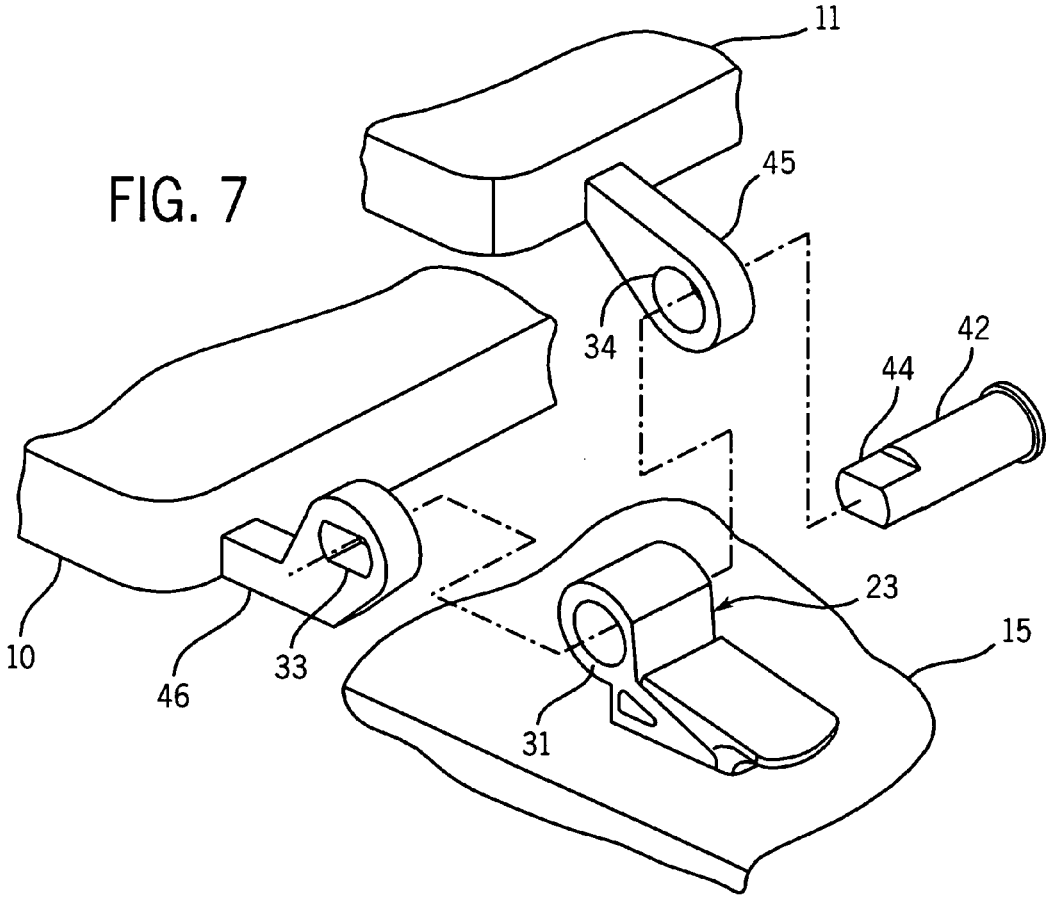

QUICK RELEASE TOILET SEAT HINGE ASSEMBLY

CROSS-REFERENCE TO RELATED APPLICATION

Not applicable.

STATEMENT OF FEDERALLY SPONSORED RESEARCH/DEVELOPMENT

Not applicable.

BACKGROUND OF THE INVENTION

The present invention relates to hinges for mounting toilet seats and/or covers to the top of rearward extensions of toilets. More particularly it relates to such hinge assemblies that permit most of the assembly parts to be readily removed from the toilet to facilitate cleaning.

In designing toilet hinge assemblies, it is preferred to design systems that can easily be installed by untrained consumers. Thus, many such hinge assemblies pre-assemble the hinge to the seat and cover, and then affix the assembly via hinge posts to a rearward extension of a toilet bowl. In such constructions the posts are typically bolted to the rearward extension using a bolt-like fastener that extends down through the extension. A nut or similar device is then screwed onto the fastener from underneath the rearward extension to clamp the assembly to the extension.

Since the consumer may need access to the underside of the extension to adjust the nut during assembly or removal, and in any event the assembly or removal can require tools in some of these designs, these assemblies are intended to be essentially permanently affixed (with perhaps an occasional tightening if the seat works its way loose). This can create a problem because the area around such hinge posts (behind and under the cover and seat) can be difficult to completely clean. In this regard, urine and other contaminants can collect around the hinge posts, with the subsequent development of an undesirable appearance or smell, or unsanitary conditions.

As such, there have been a number of attempts to develop toilet seat hinge assemblies where the seat and cover and associated pivot pins can be removed from the toilet relatively easily, and then (after cleaning) be relatively easily reconnected. See e.g. U.S. Pat. Nos. 4,159,548, 4,326,307, 4,965,889, 5,933,875, and 6,070,295. See also GB 2,280,219 A.

These systems do achieve better cleaning by leaving only small hinge posts essentially permanently affixed to the bowl rearward extension, while providing readily releasable subassemblies that can removably link up with these posts. However, these prior art systems have a variety of deficiencies.

For example, some rely on a relatively weak connection between the subassembly and hinge posts such that the subassembly can accidentally be knocked off the posts. Others rely on relatively weak parts which may have a high incidence of breakage over prolonged use. Still others require relatively complex multi-part assemblies, which increase the cost of production and may require some consumer training.

Still other assemblies require tools for the disassembly for cleaning purposes. Yet others require a consumer to touch portions of the assembly that may themselves be contaminated.

Hence, it can be seen that a need still exists for an improved toilet seat hinge assembly, particularly one which facilitates removal of the seat and cover for cleaning purposes.

BRIEF SUMMARY OF THE INVENTION

The present invention provides a hinge assembly for linking a toilet covering element (e.g. a toilet seat, a toilet cover, or a toilet seat/cover combination) to a rearward portion of the toilet. The preferred mounting location is a horizontal upwardly facing surface of a rearward extension of a toilet bowl.

The hinge assembly has a base member adapted to be mounted adjacent the rearward portion of the toilet. A base member has a flexible projection extending there from (preferably outwardly there from). There is also a fastener (preferably a bolt) extendable through the base member for fastening the base member to the rearward portion of the toilet.

The hinge support member is adapted to support the toilet seat/cover, preferably in a pivotable fashion. This can be achieved in a number of ways. For example, it can be achieved via an essentially horizontally extending pin which forms a pivot axis for the seat and cover (compare pin 64 in U.S. Pat. No. 4,159,548), or via a more complex dash pot type pin (compare U.S. Pat. No. 6,052,869).

Typically, such seats and covers both have a pair of spaced rearwardly extending ears, with cross holes extending through or at least into all of the ears. For example, one of the pins from the present invention can extend through a seat left rear ear and then into a cover left rear ear. Another of the pins can extend through a cover right rear ear and into a seat right rear ear.

In any event, the hinge support member has a side wall with an opening therein. Preferably, it has two opposed side walls separated by an internal downwardly open cavity, with both of the side walls having such side wall openings.

The hinge support member can be positioned such that the base member projection extends into a hinge support member side wall opening to thereby link them together. Thereafter, the projection can be flexed inwardly to facilitate disconnection of the hinge support member from the base when such disconnection is desired.

When there are two such base member projections which interfit with the two side wall openings, squeezing opposed sides of the base member by contact with the opposed projections will facilitate the release.

The base member can have a vertical through hole. When it does, the fastener is preferably a bolt extendable through the vertical through hole. There is also then a nut positionable on the bolt underneath the rearward extension.

When the hinge support member has an internal downwardly open cavity, that cavity can also be in communication with an upward opening. In such an embodiment there is a pivotable cover for covering and uncovering the upward opening.

This assembly permits two small base members to be essentially permanently attached to the bowl rearward extension, at separated positions. When no seat or other hinge parts are present, this permits the rear area of the bowl top to be easily and effectively cleaned.

One can then take a pre-assembled seat/cover/two hinge support assembly and snap two hinge supports down over the base supports, thereby fixing the hinge supports (and thus the seat and cover) to the bowl rearward extension. The toilet seat and cover can then pivot in the usual fashion as needed.

When removal of the main parts of the assembly is desired for cleaning, one may squeeze both sides of both bases through the hinge support side wall holes. The flexibility of the projections allows them to deflect inwardly in response to this force (and out of an interfering position). This permits everything but the base members, nuts and bolts to be vertically lifted up away from the toilet.

Re-assembly is even easier. One merely needs to align the hinge supports over the base members and push the hinge supports down onto the base members until the projections lock to the hinge supports.

It will be appreciated that the hinge assembly of the present invention has a number of important advantages. For one thing, it is comprised of few parts and thus can be inexpensively manufactured. Further, its mechanism of operation does not require a consumer to touch an area of the assembly that is likely to be contaminated.

Moreover, the connection is solid, thereby precluding accidental undesired dislodging of the assembly. Further, the parts can be formed to present an aesthetically pleasing appearance.

In one embodiment, the hinge support member always shrouds the base. Thus, to tighten or remove the fastener the hinge support member is removed.

However, in another embodiment the hinge support member has a pivotable cover which when open provides access to the top of the fastener. In this embodiment, the entire assembly can be removed as a unit, or installed as a unit.

In another aspect the invention provides another hinge assembly for linking a toilet covering element to a rearward portion of the toilet. The assembly has a base member adapted to be mounted adjacent the rearward portion of the toilet, the base member having a side opening therein, a fastener extendable through the base member for fastening the base member to the rearward portion of the toilet, and a hinge support member adapted to support the toilet covering element, the hinge support member having a flexible projection extending there from.

The hinge support member of this embodiment is selectively positionable so that its flexible projection can be received in the base member side opening to couple the hinge support member to the base member. Further, the hinge support member is coupled to the base member, the projection is flexible outwardly to selectively disconnect the hinge support member from the base member.

It will be appreciated that the present invention permits rapid assembly and disassembly of the main cover elements from the top of the toilet, without the use of special tools, and without the need for complex training. These and still other advantages of the present invention will be apparent from the description that follows. The claims should be looked to in order to judge the full scope of the invention.

DETAILED DESCRIPTION OF THE INVENTION

Figure 1:
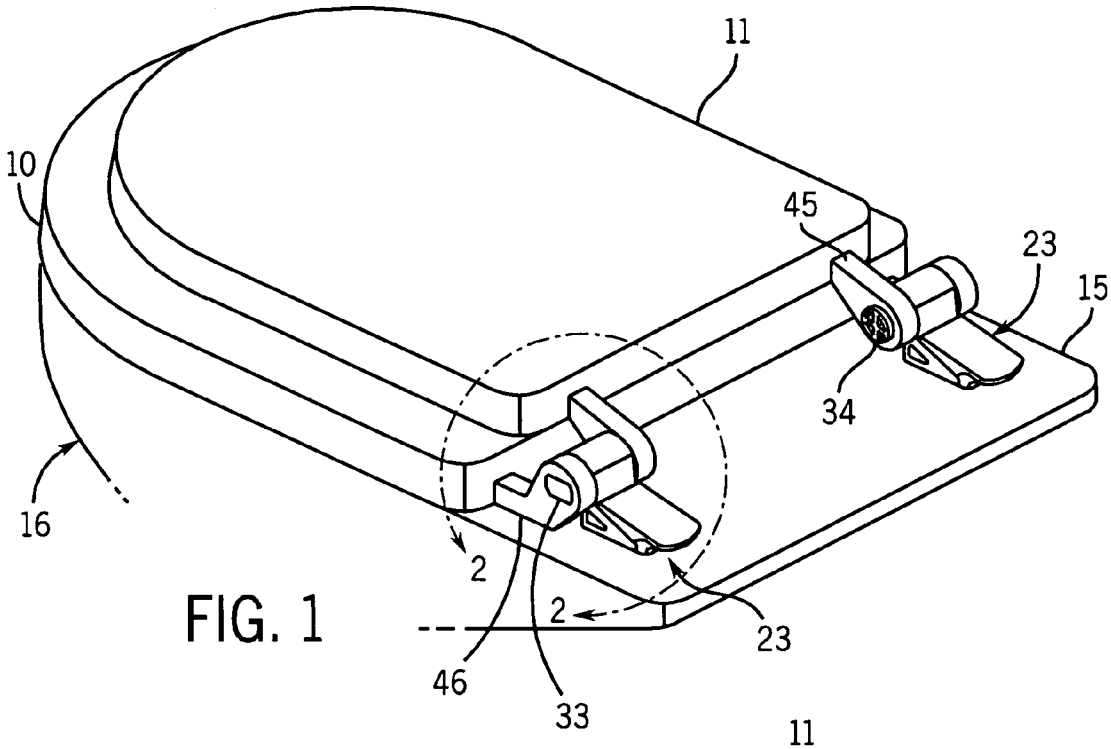
FIG. 1 is a rear perspective view showing two hinge assemblies of the present invention mounted on a toilet bowl rear extension.
Figure 2:
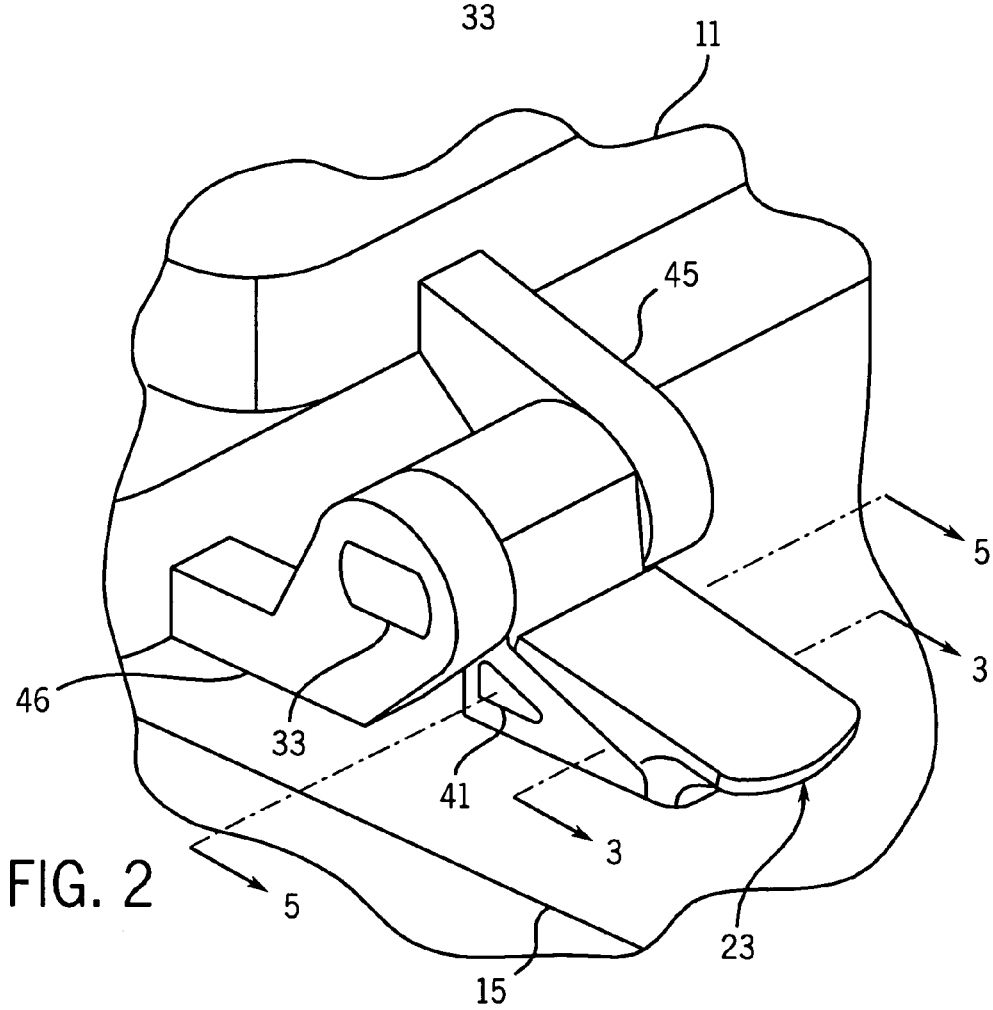
FIG. 2 is an enlarged detail perspective view of region 2-2 of FIG. 1.

Referring now to FIGS. 1 and 2, a toilet assembly includes a conventional toilet bowl 16 provided with the usual seat 10 and cover 11. The seat 10 and cover 11 each include the usual rearwardly projecting ears 45 and 46 which extend over a rearward extension 15 of the toilet bowl 16. The ears 45/46 each include a horizontal through bore 33/34 for receiving a horizontally extending mounting pin to pivotally mount the seat and cover for pivoting along a horizontal axis defined by hinge assemblies (generally 23).

Figure 3:
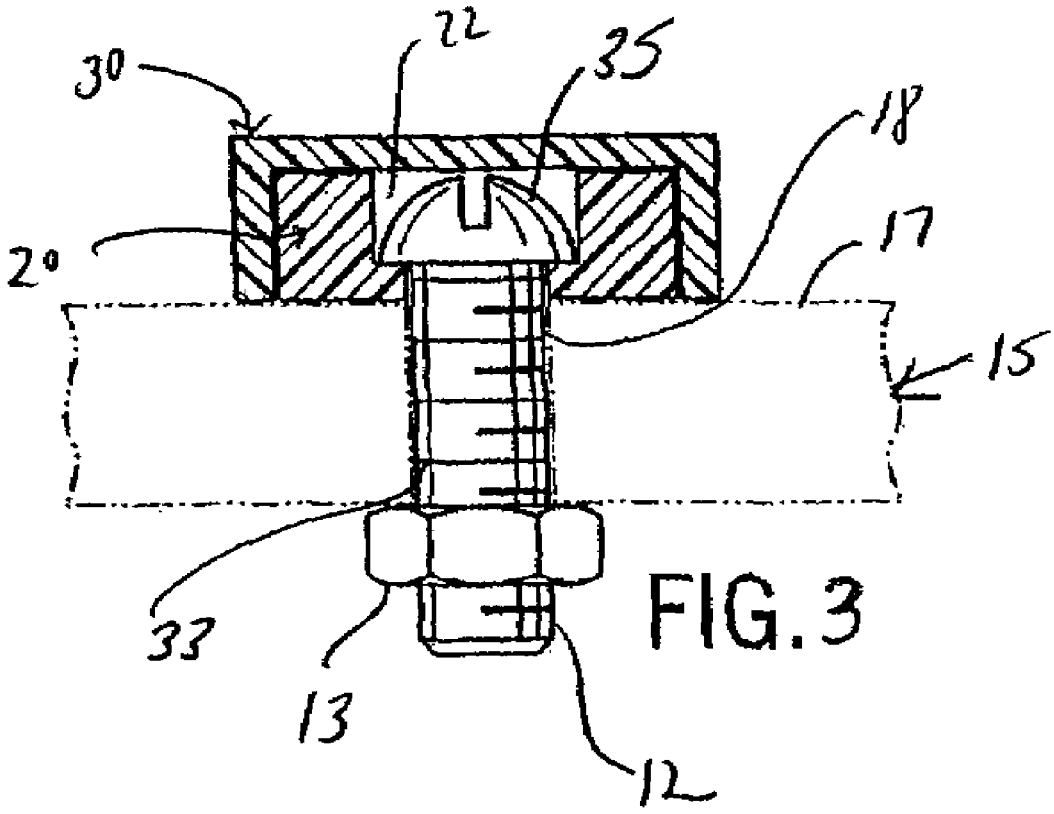
FIG. 3 is a vertical sectional view taken along the line 3-3 of FIG. 2.
Figure 4:
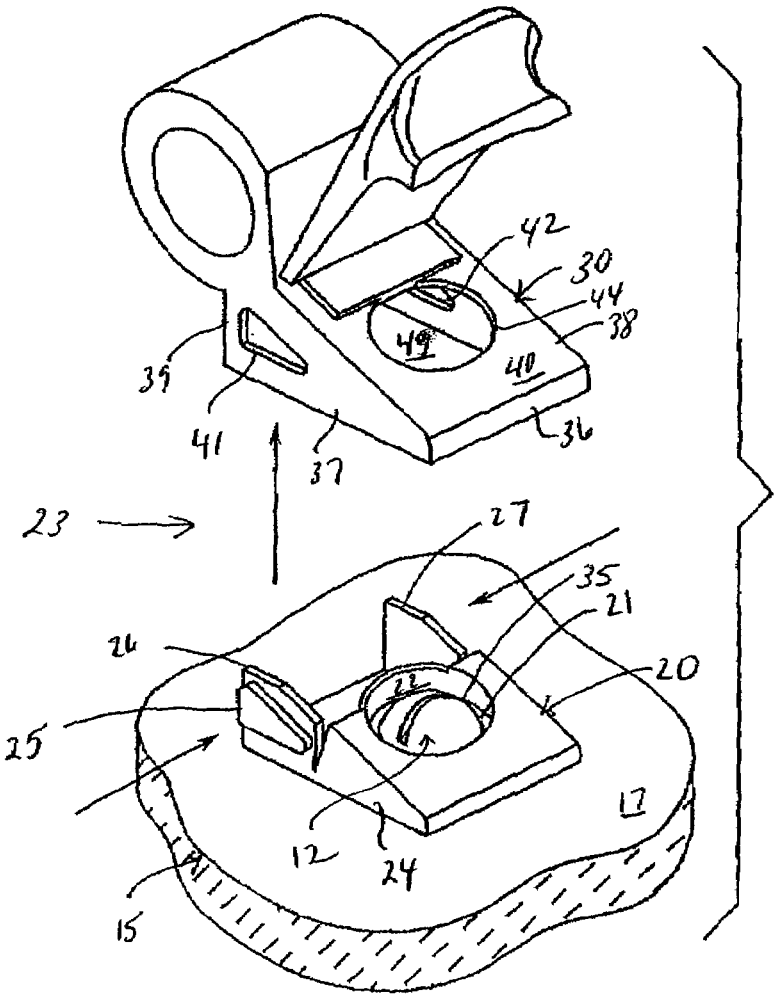
FIG. 4 is an exploded view of a hinge assembly of FIG. 1, without the hinge pins, seat or cover being shown.

Referring now also to FIG. 3, the rearward extension 15 of the toilet bowl has the usual top surface 17, through which vertical through holes 18 are formed to receive bolts 12 for mounting the hinge assemblies 23 to the toilet bowl 16. As shown in FIG. 4, the two hinge assemblies 23 each include a base member 20 and a hinge support member 30. The base members 20 have a vertical through hole 21 which opens at its top into an enlarged recess 22. The bolts 12 are inserted through the holes 21 so that the heads 35 of the bolts 12 rest in the recesses 22 while lower portions 33 of the bolts extend down through the through holes 18 in the extension 15.

The lower portions 35 of the bolts 12 are threaded in the usual fashion so that nuts 13 can be threaded onto them with or without a washer to clamp the bases 20 in place. It should be appreciated that this is a relatively permanent connection as a tool would normally be needed to facilitate the removal.

The bases 20 each have two side walls 26 and 27 which are made flexible relative to the bottom walls 24 of the bases 20. Further, the side walls 26 and 27 each have outwardly extending projections 25. The projections 25 extend slightly farther outward than the side walls 26 and 27.

Each hinge support member 30 includes a front wall 36, two opposed side walls 37 and 38, and a rear wall 39. The side walls have side openings 41 and 42 which preferably have a corresponding cross section (e.g. contoured triangular) which matches that of the base projections 25.

The walls 36, 37, 38, and 39 of each hinge support member 30 define an internal, downwardly open cavity 49, sized and dimensioned to allow a support member 30 to be slid over and to surround a base member 20. As the walls 36, 37, 38, and 39 are slid over a base 20, projections 25 are forced to flex inwardly until they align with the side openings 41 and 42.

Figure 5:
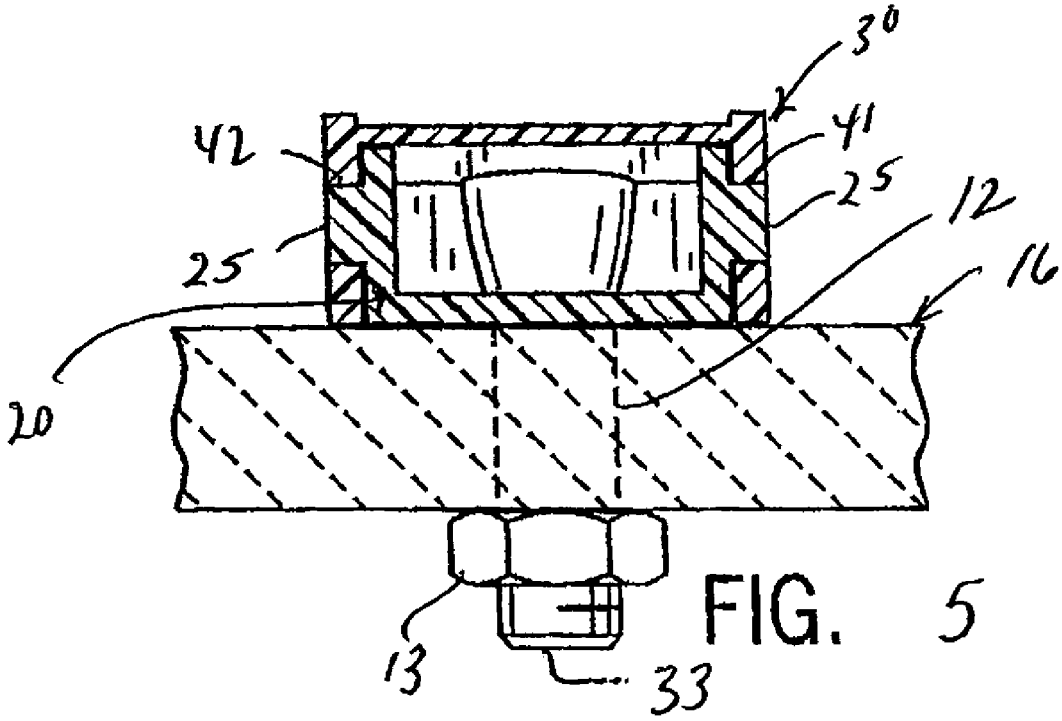
FIG. 5 is a vertical sectional view taken along the line 5-5 of FIG. 2.

As will be evident from FIG. 5, when the projections 25 align with the openings 41 and 42, the projections 25 snap into the side openings 41 and 42 to "lock" the hinge support member 30 to the base member 20, and thus lock the hinge support member 30 to the toilet bowl 16.

Figure 6:
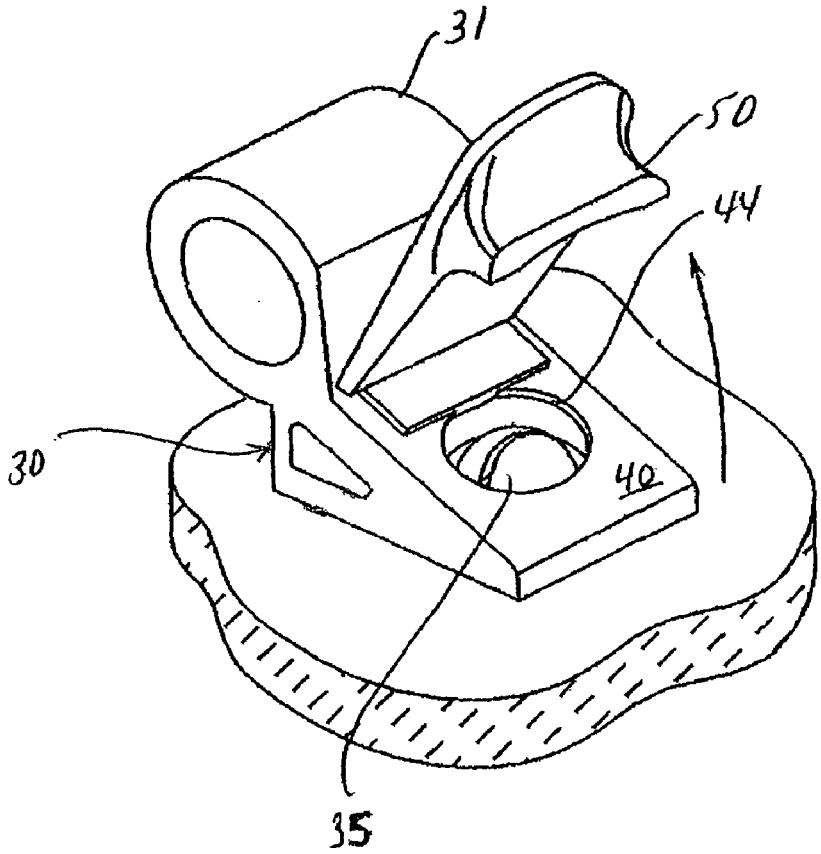
FIG. 6 is a perspective view of the FIG. 4 hinge assembly, once the hinge support has been mounted on the base.

Referring now to FIGS. 4 and 6, the hinge assemblies 23 can each also include a top wall 40 including an opening 44 which, when present, is preferably aligned with the head 35 of the bolt 12 so that the bolt 12 can be accessed without removing the hinge support 30. The hinge assemblies 23 can also include a pivotable cover 50, which can be, as shown, formed integral with the hinge support 30 or, alternatively, as a separate piece anchored via legs (not shown). The cover 50 can be selectively positioned to cover (FIG. 2) or uncover (FIG. 6) the opening 44.

Figure 7:
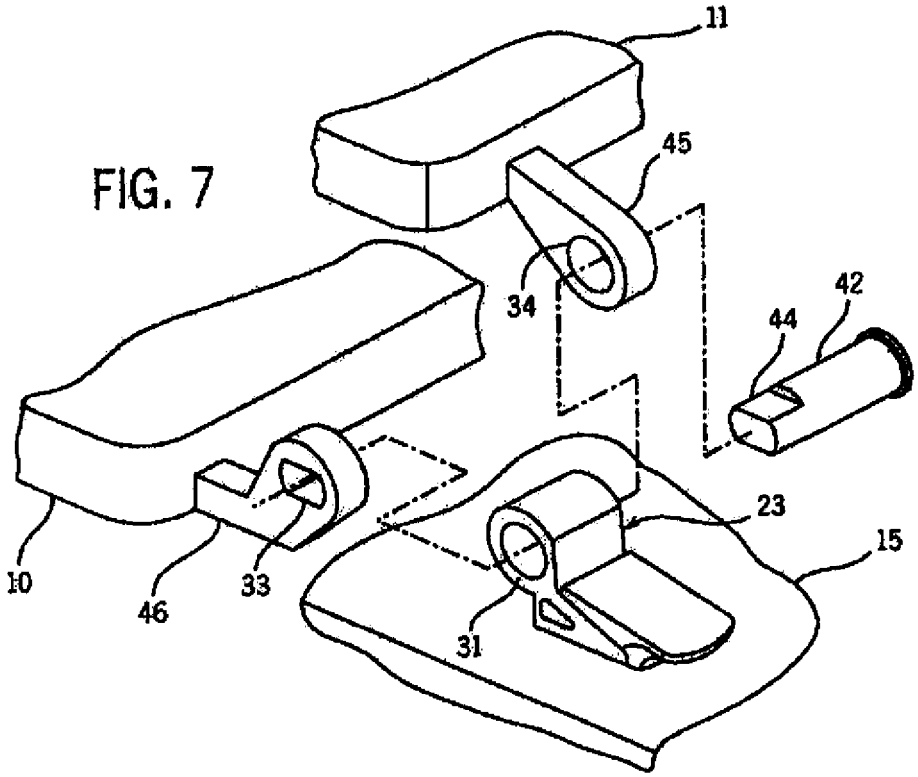
FIG. 7 is an exploded schematic view depicting how, after the FIG. 6 support cover has been closed, the seat and main cover could be mounted thereto.
Figure 7:
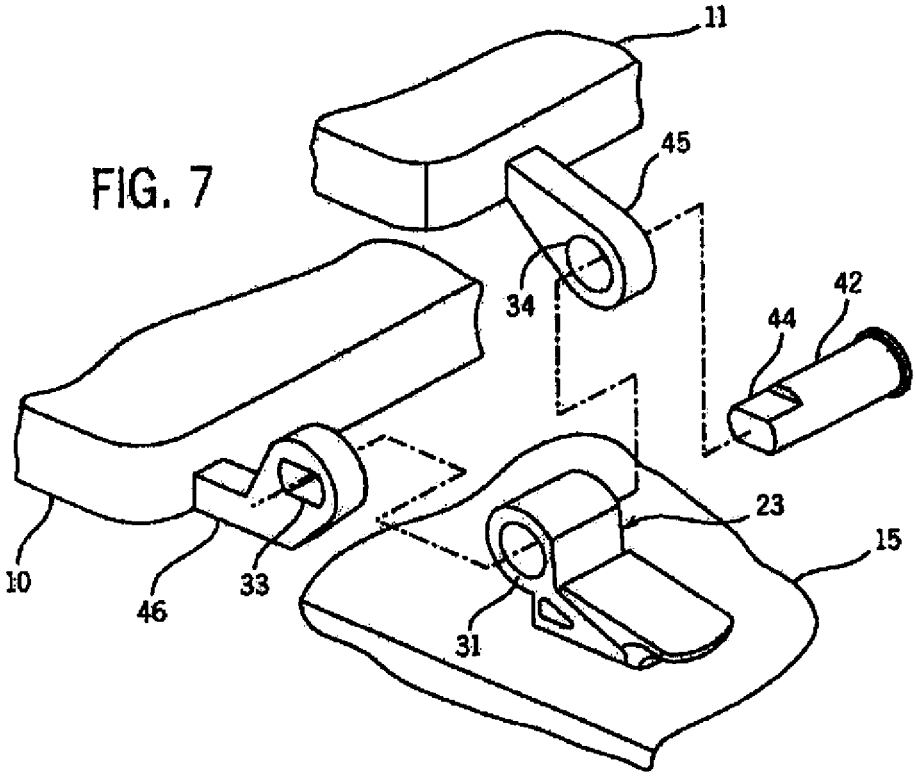
Figure 3:
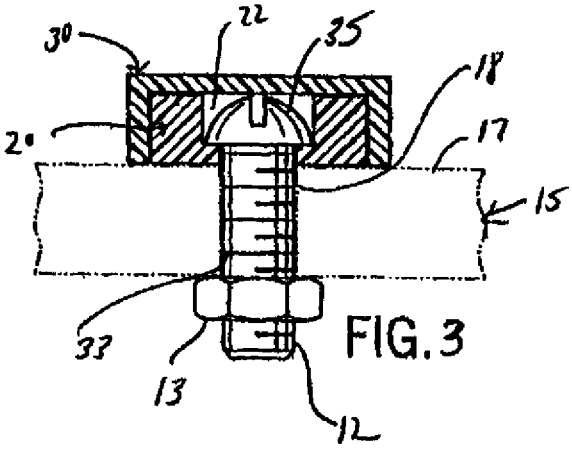
Figure 4:
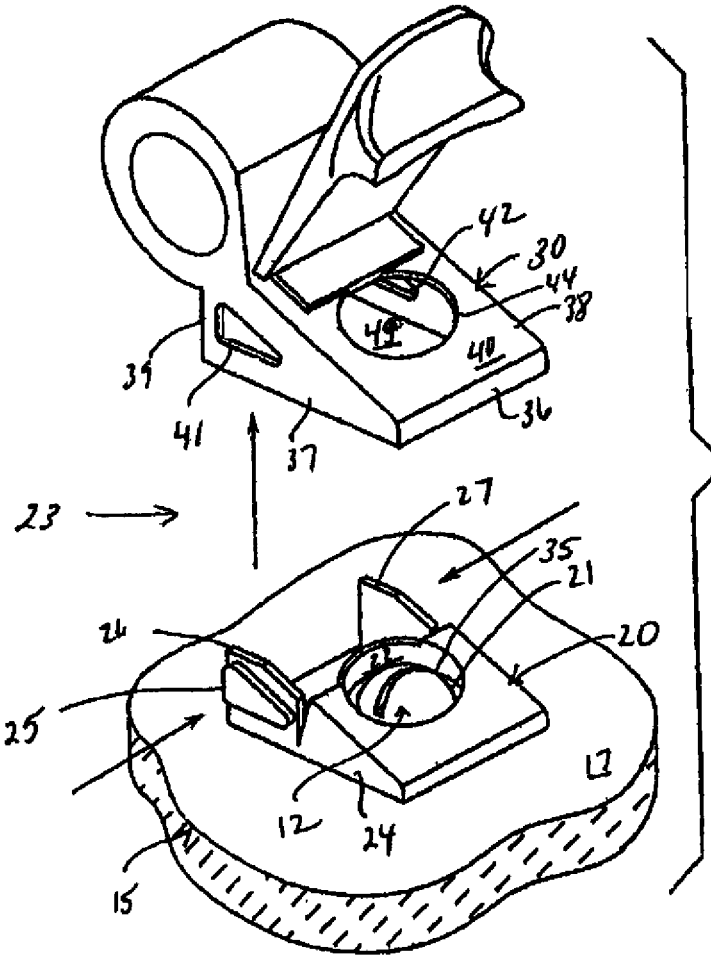
Figure 5:
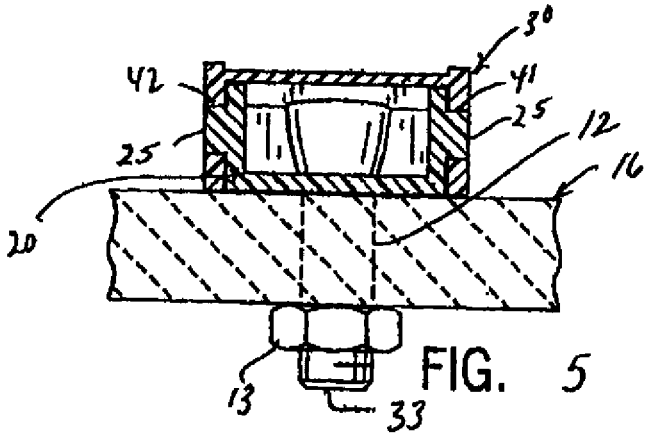
Figure 6:
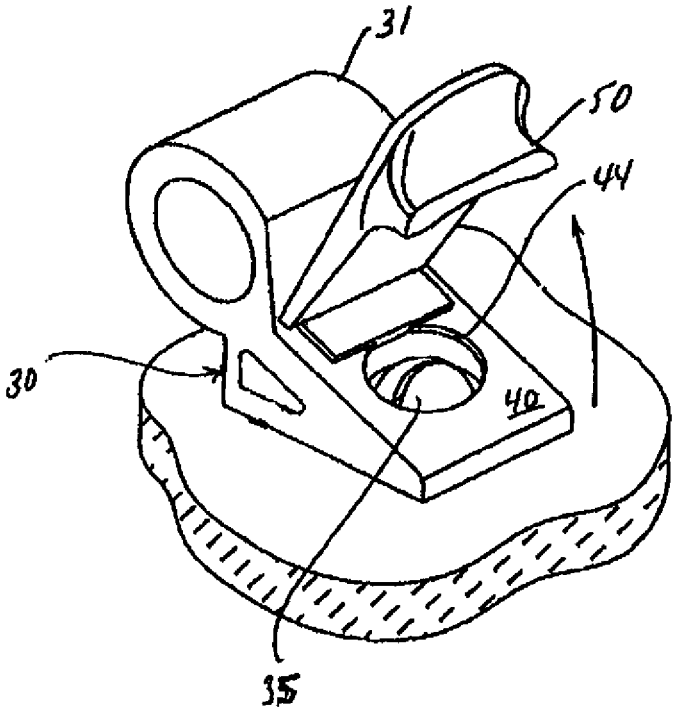
Figure 8:
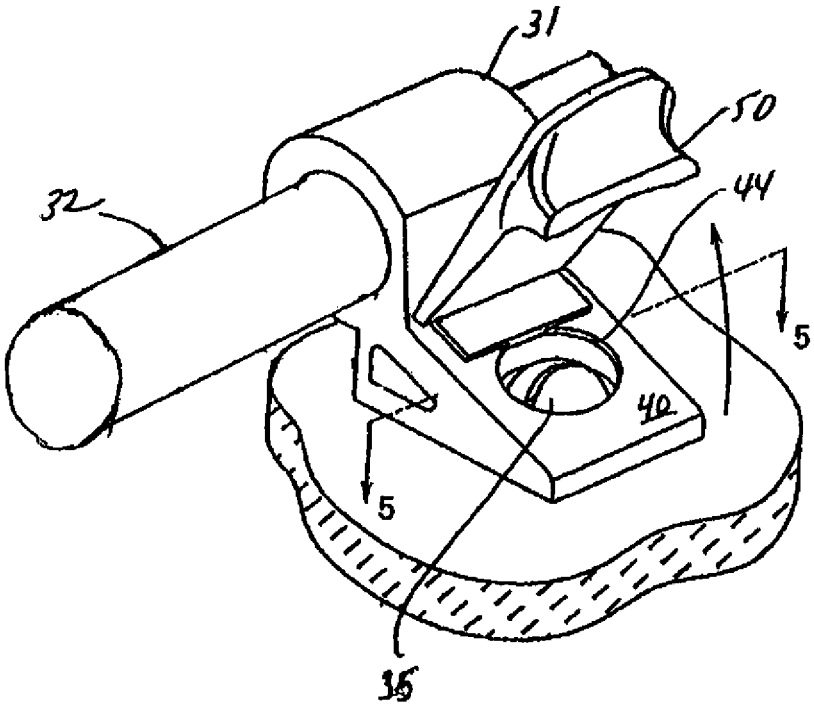
Figure 9:
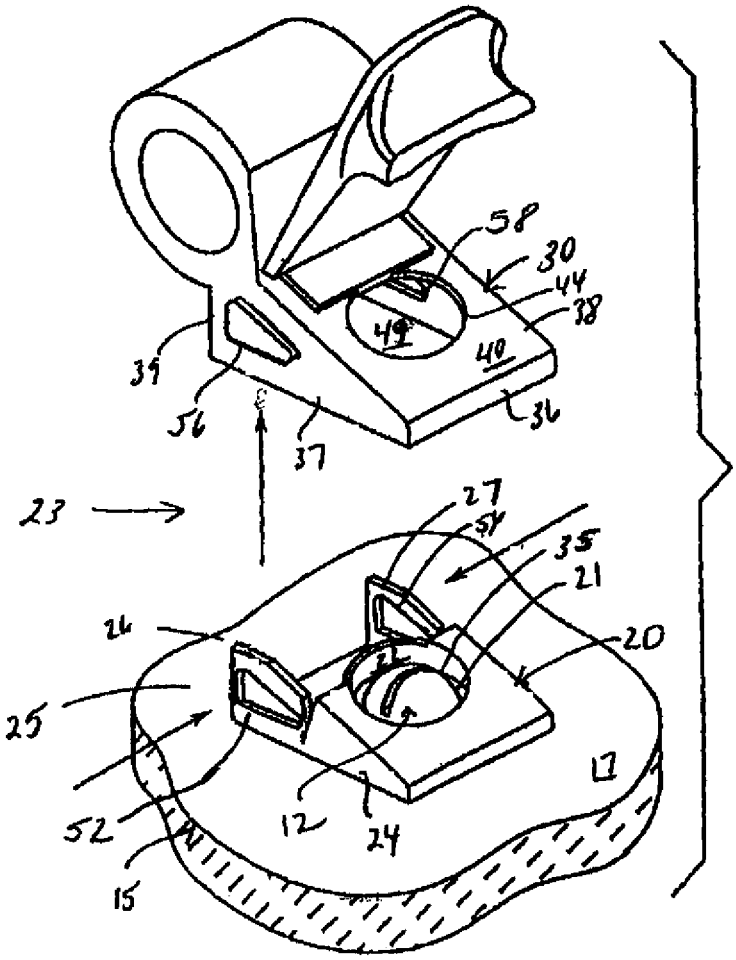
Figure 1:
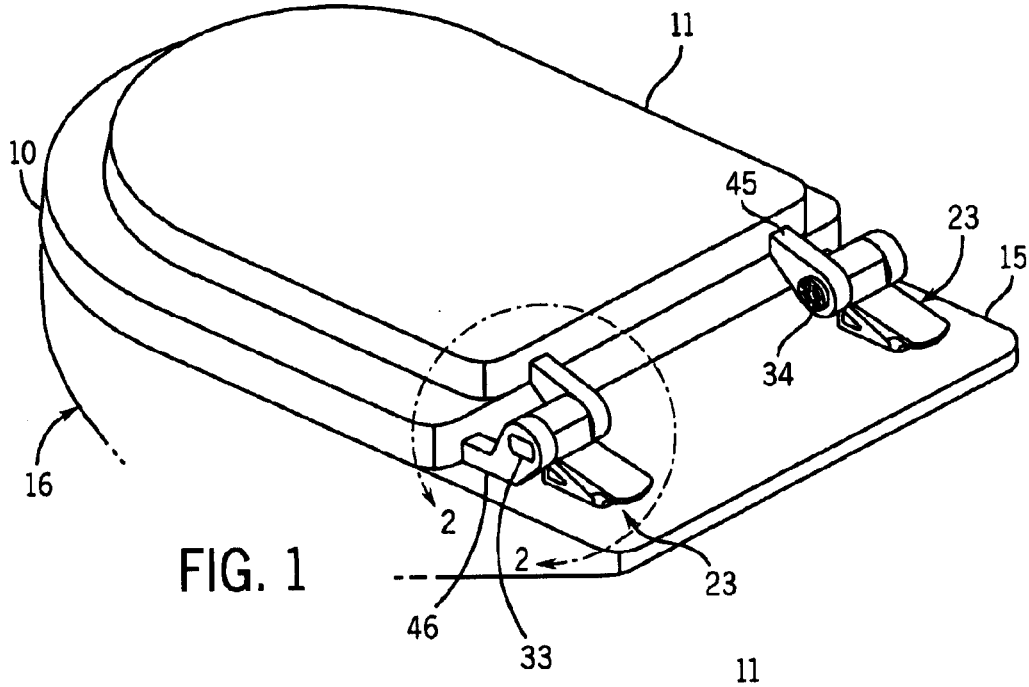
Figure 2:
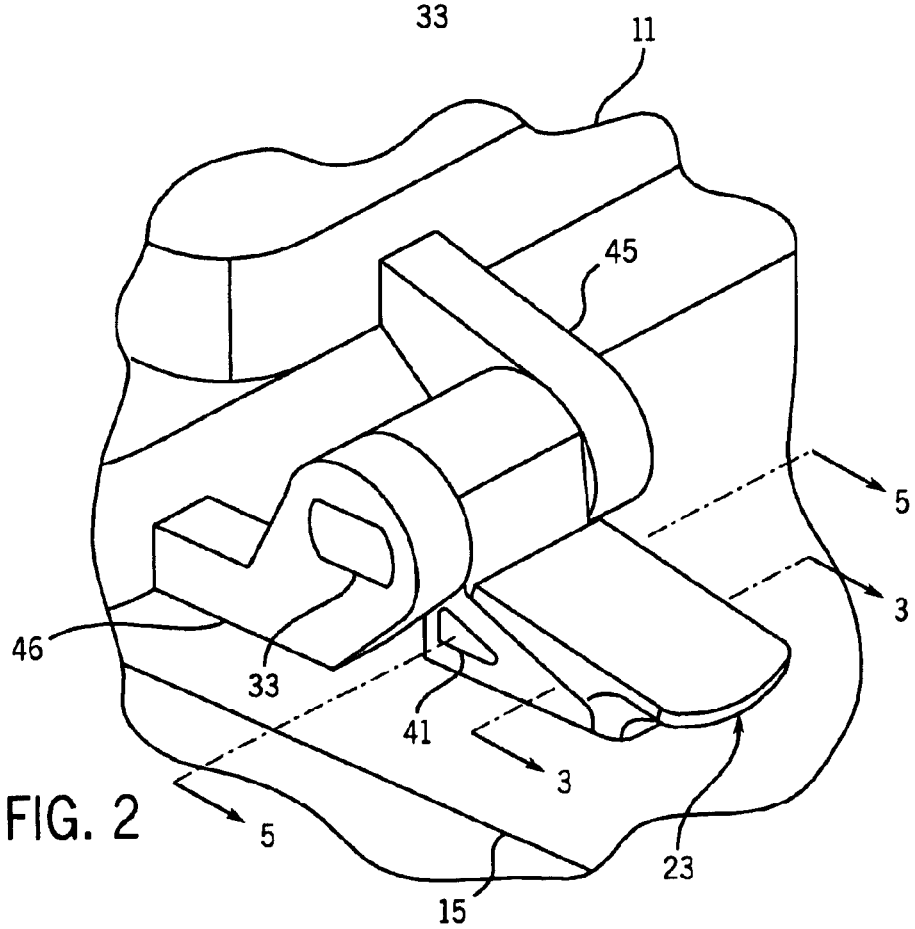
Figure 3:
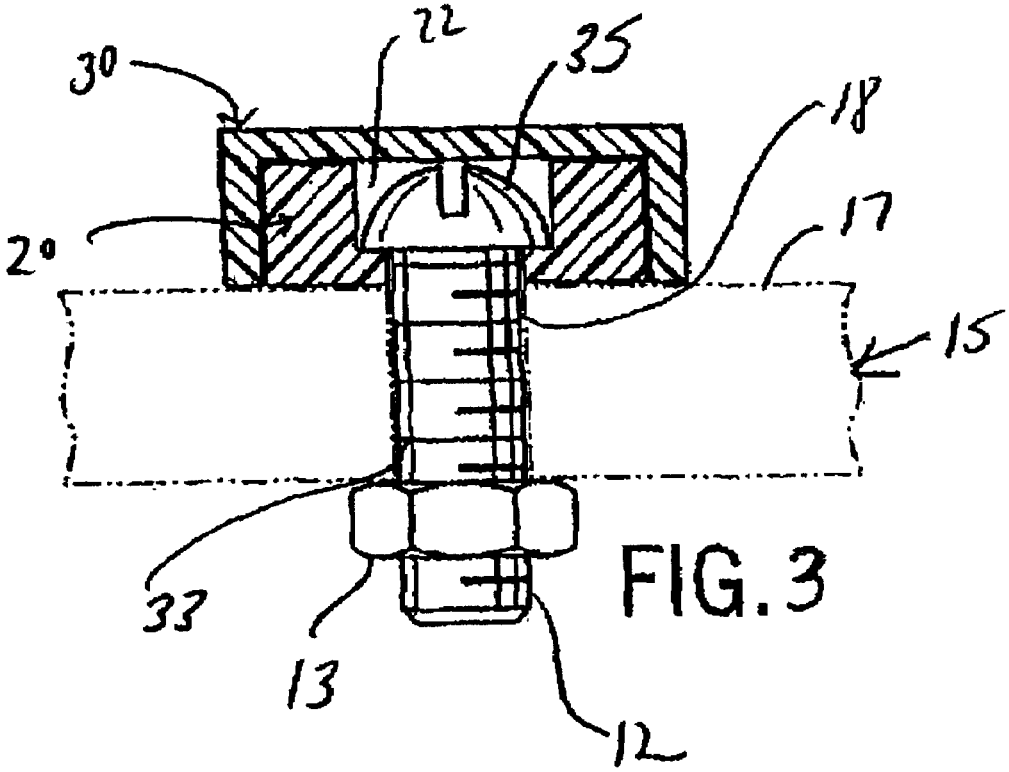
Figure 4:
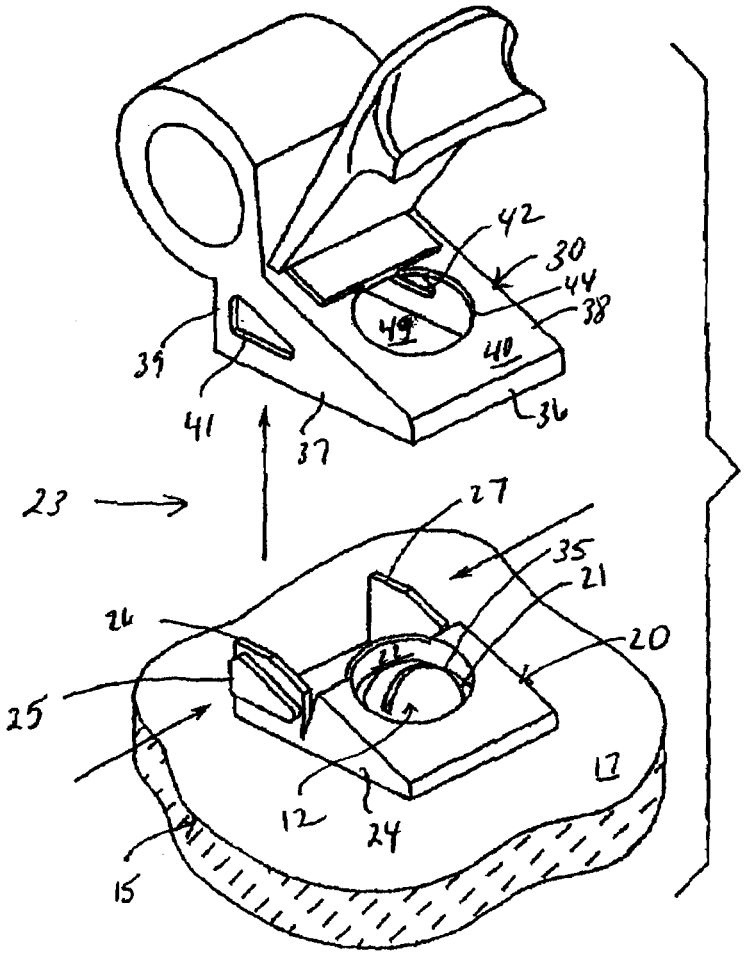
Figure 5:
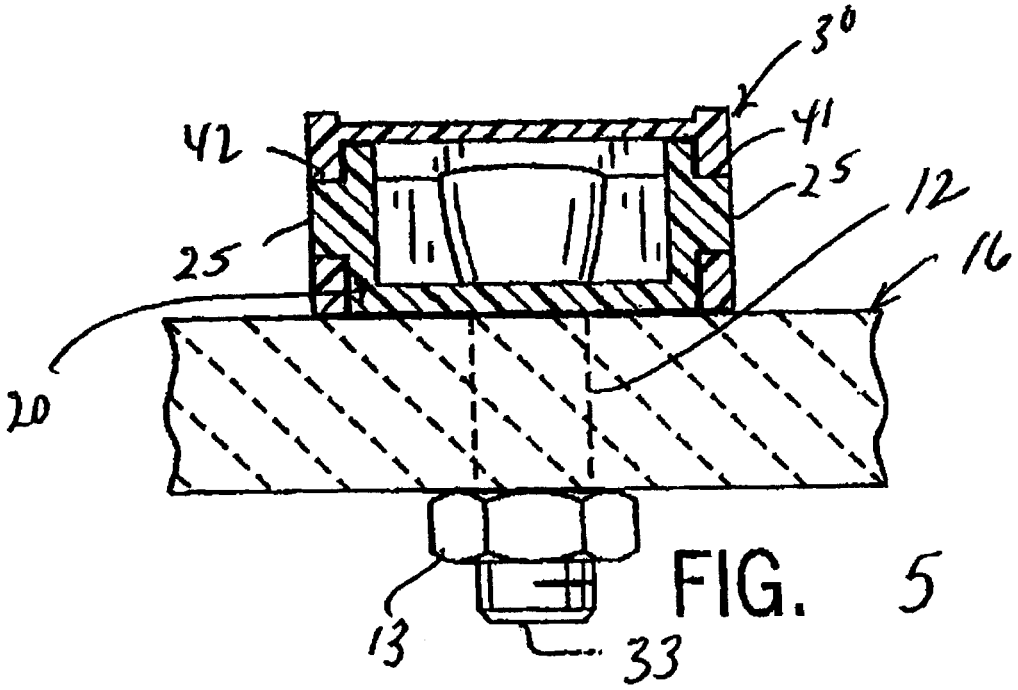
Figure 6:
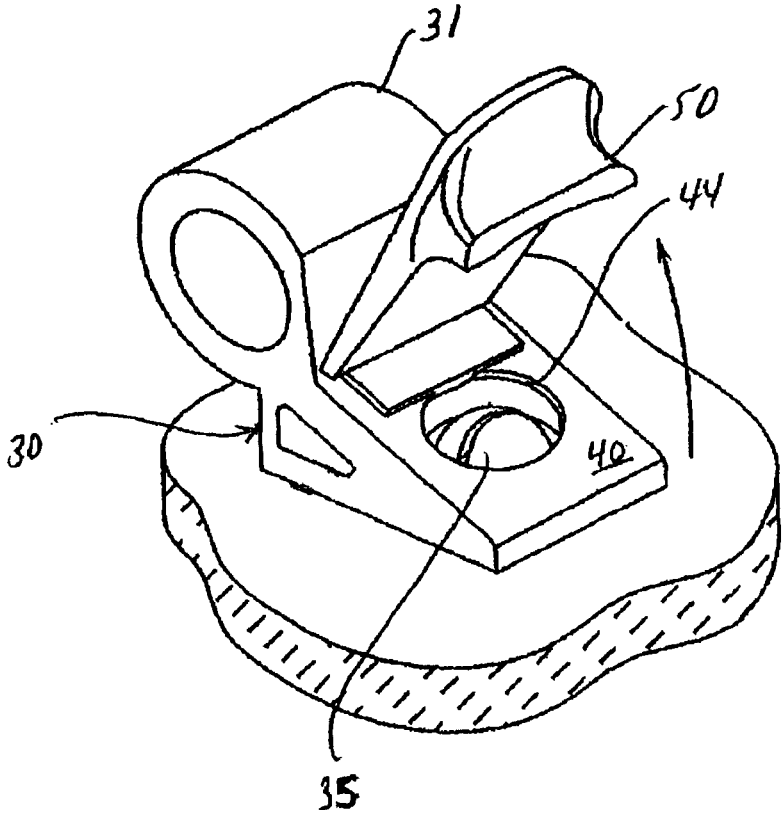
Figure 7:
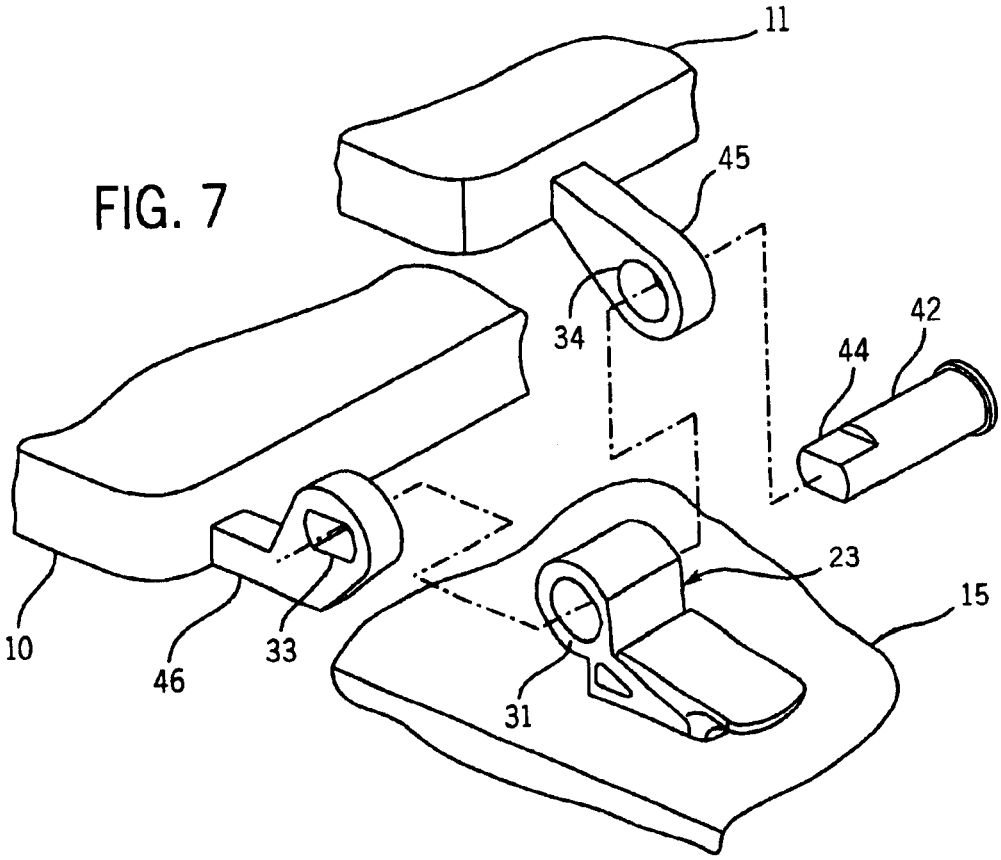
Figure 8:
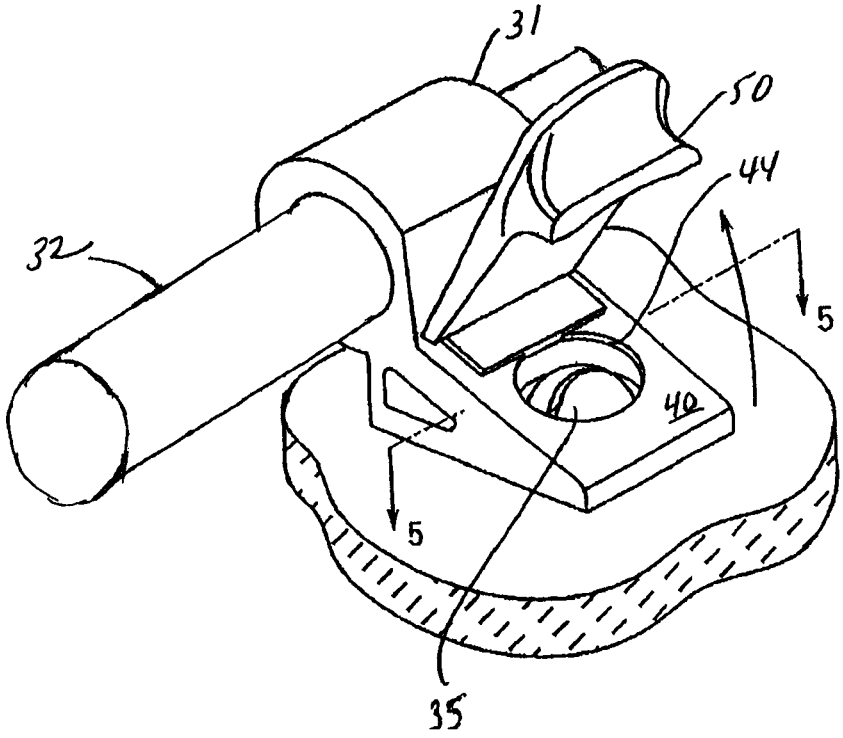
Figure 9:
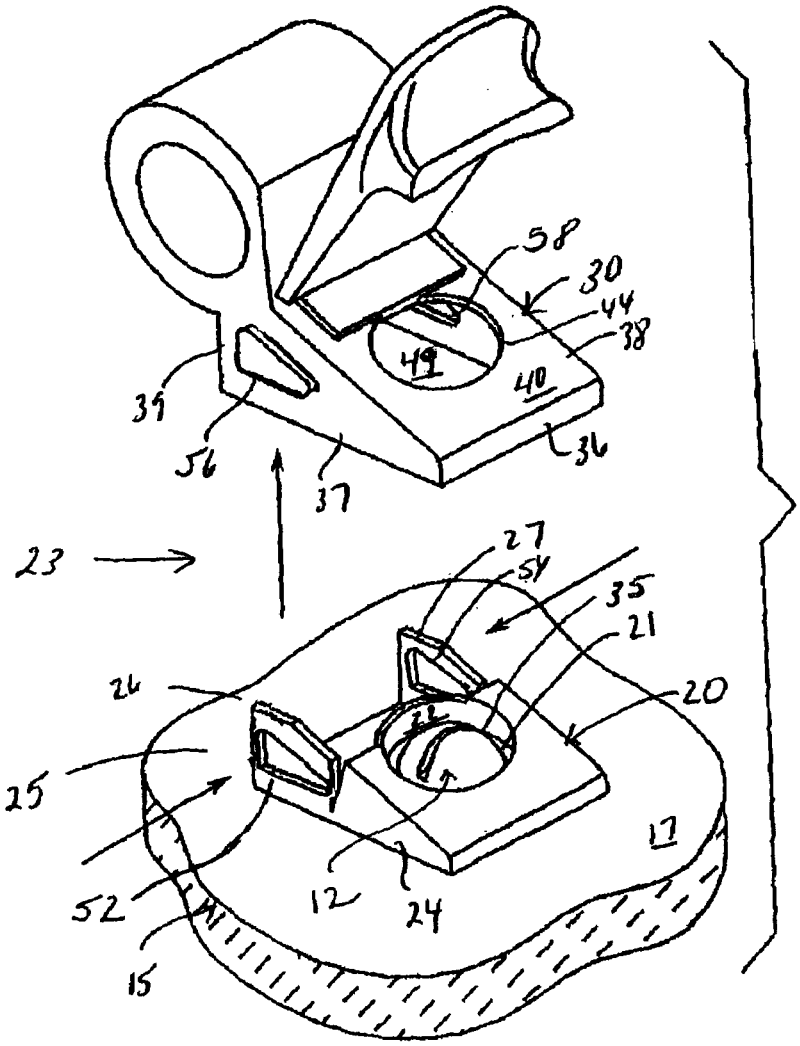

The hinge assemblies 23 each include a horizontal raised structure 31 which facilitates the coupling of the seat 10, the cover 11, or both, to the toilet bowl 16. For example, as shown in FIG. 7, the horizontal raised structure 31 can be a hollow cylinder into which a dash pot cylinder 42 is positioned to damp motion of the seat 10 and cover 11 when released. The dash pot 42 extends through the hole 34 provided in the mounting tab 45 in the cover 11, and through the cylindrical horizontal raised structure 31.

The dash pot 42 may further include an extending pin section 44 that is received in the hole 33 in the seat 10 to couple the seat 10 and cover 11 to the hinge assembly 23, thereby forming a subassembly which can be removed from the toilet bowl 16, as described below. As shown, the hole 33 and extending pin 44 are shaped and dimensioned to provide a mounting socket or receptacle.

Figure 8:
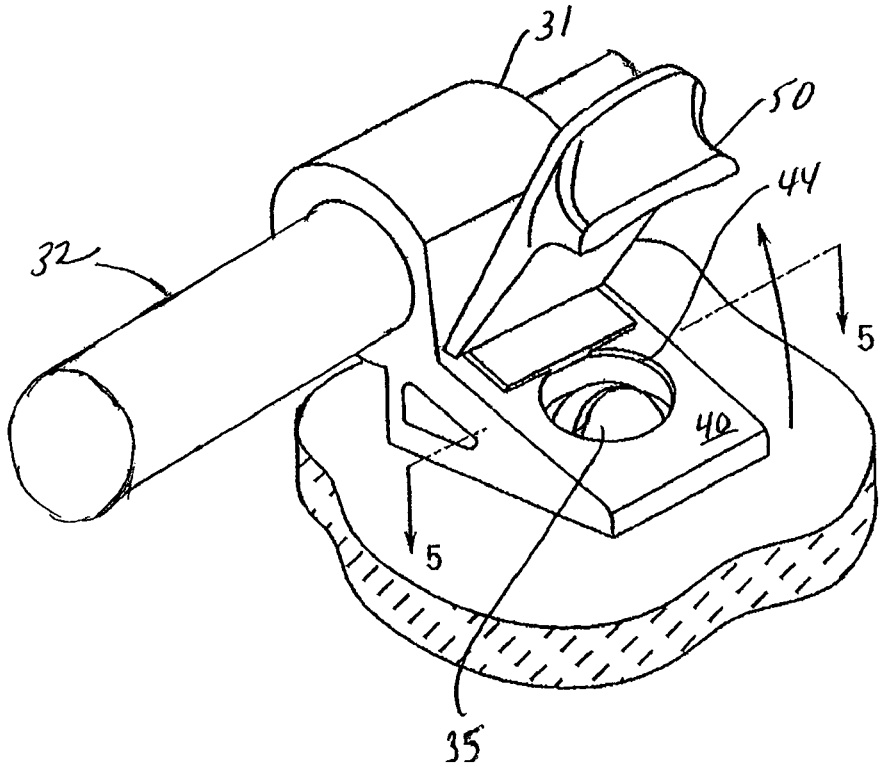
FIG. 8 is an alternative embodiment where the hinge support has an integral mounting pin.

Referring now to FIG. 8, in an alternative embodiment, the horizontal raised structure 31 can be integrally formed with a pin 32 that can be used to mount the seat 10 and/or cover 11 through the mounting holes 33 and 34. The pin 32 provides for horizontal pivoting of the seat 10 and/or cover 11 about an axis defined through the holes 33 and 34. The pin 32 can also be provided as a separate structure shaped and dimensioned to insert into an aperture in the horizontal structure, or be provided as a combination of both integral and separate pins.

Regardless of the form of the horizontal structure 31, the hinge support members 30 connect the associated cover 10 and seat 11 to the base members 20. To provide the connection, the support members 30 are moved vertically down over the base member 20 until the walls of the hinge support members 30 shroud the base member 20, as described above.

The hinge support member 30 can be selectively disconnected from the base member 20 by squeezing the side walls 37 and 38 of the hinge support members 30 inward through the openings to drive the projections 25 out of the side wall openings 41 and 42 of the hinge support member 30. After the hinge support member 30 is unlocked from the base member 20, the subassembly including the seat 10, cover 11 and hinge support members 30, can be lifted from the toilet bowl 16 to facilitate cleaning.

Figure 9:
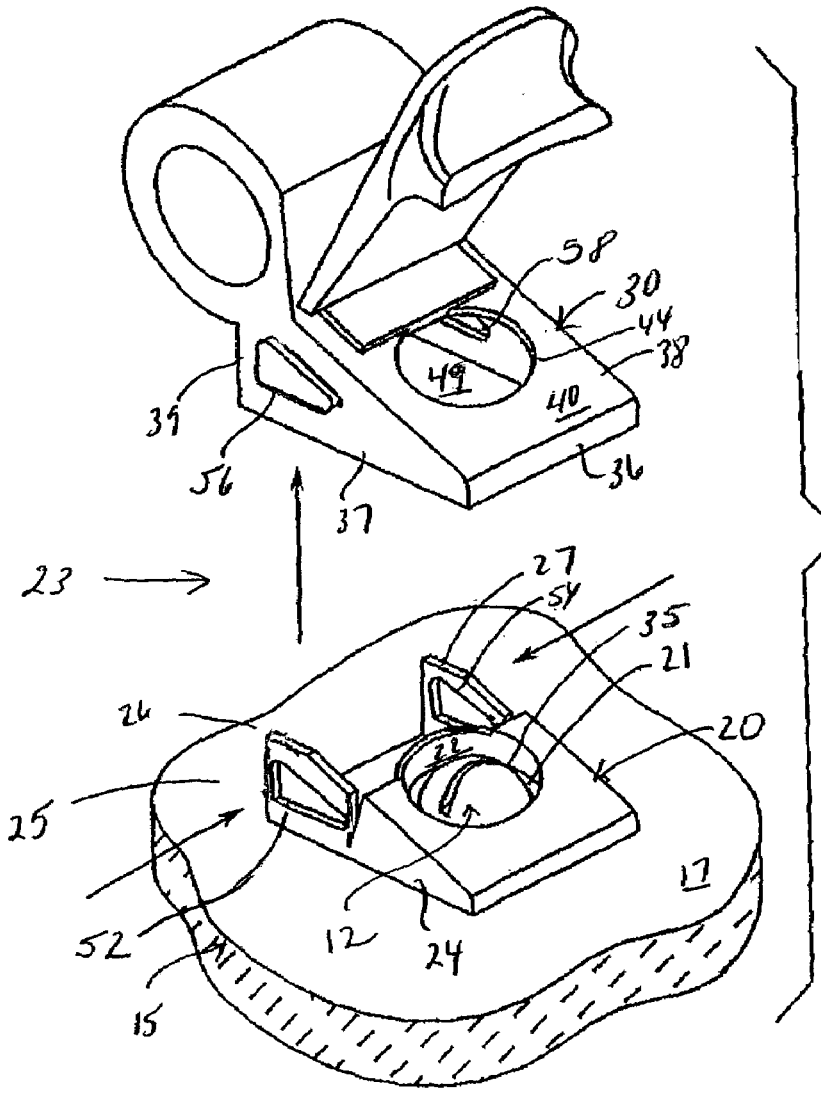
FIG. 9 is an alternate embodiment where side openings are provided in the base, and flexible projections are provided on the hinge member.

While preferred embodiments have been shown, a wide variety of changes can be made to them without departing from the spirit or scope of the invention. For example, the pins on the hinge supports can point towards each other, or away from each other, or both ways, depending on the configuration of the rear attachment ears extending from the cover and seat. Additionally, referring now to FIG. 9, although the hinge assembly is described as having openings in the hinge support and projections in the base member, it will be apparent that this configuration could be reversed, such that the projection 56, 58 is provided in the hinge support 30 and the opening 52, 54 in the base member 20.

Further, although a toilet covering member including both a cover and a seat has been described, it will be apparent that various types or combinations of covering members can be used. For example, it is not necessary there be both a cover and seat. Either can be attached alone if desired (e.g. for a public restroom just a seat is more typical).

Thus, the claims should be looked at in order to judge the full scope of the invention.

INDUSTRIAL APPLICABILITY

The present invention provides a hinge assembly suitable to attach a toilet seat and/or cover to a toilet.

I claim:

1. A hinge assembly for linking a toilet covering element to a rearward portion of the toilet, the assembly comprising:

a base member including a flexible vertical sidewall and adapted to be mounted adjacent the rearward portion of the toilet, the base member having a projection extending from the flexible vertical sidewall;

a fastener extendable through the base member for fastening the base member to the rearward portion of the toilet;

a hinge support member adapted to support the toilet covering element, the hinge support member having an opening therein;

wherein the hinge support member is selectively positionable to receive the projection of the base member in the opening to couple the hinge support member to the base member; and whereby when the hinge support member is coupled to the base member, the projection can be moved inwardly to selectively disconnect the hinge support member from the base member.

2. The hinge assembly of claim 1, wherein the toilet covering element is selected from the group consisting of toilet seats, toilet covers, and combined toilet seats and covers.

3. The hinge assembly of claim 1, wherein the base member has a vertical through hole, the fastener is a bolt extendable through the vertical through hole, and the assembly further comprises a nut positionable on the bolt underneath the rearward extension.

4. The hinge assembly of claim 1, wherein the hinge support member has an internal, downwardly open, cavity in communication with an upward opening and the opening of the hinge support member.

5. The hinge assembly of claim 4, wherein the hinge support member is provided with a pivotable cover for covering and uncovering the upward opening.

6. The hinge assembly of claim 1, wherein the binge support member is connected to a hinge pin so as to provide an essentially horizontal pivot axis for the toilet covering element.

7. The hinge assembly of claim 1, wherein the base member has two such flexible vertical side walls, both having a projection extending there from, wherein said projections extend in opposed directions.

8. The hinge assembly of claim 7, wherein the hinge support member has opposed side walls, both of which have at least one such opening.

9. The hinge assembly of claim 1, where there are two such base members and two such hinge support members.

10. A hinge assembly for linking a toilet covering element to a rearward portion of the toilet, the assembly comprising:

a base member adapted to be mounted adjacent the rearward portion of the toilet, the base member having a side opening therein;

a fastener extendable through the base member for fastening the base member to the rearward portion of the toilet;

a hinge support member adapted to support the toilet covering element, the hinge support member having a projection extending there from;

wherein the hinge support member is selectively positionable so that its projection can be received in the side opening of the base member to couple the hinge support member to the base member; and whereby when the hinge support member is coupled to the base member, the base member has a vertical sidewall that is flexible to selectively disconnect the hinge support member from the base member.

* * * * *

UNITED STATES PATENT AND TRADEMARK OFFICE

CERTIFICATE OF CORRECTION

PATENT NO. : 7,389,549 B2
APPLICATION NO. : 10/949131
DATED : June 24, 2008
INVENTOR(S) : Erich C. Vierkant, III It is certified that error appears in the above-identified patent and that said Letters Patent is hereby corrected as shown below:

In the drawings, delete the second Fig. 6 (the one appearing on the same page as Fig. 7).

In line 1 of claim 6, change [binge] to --hinge--.

Signed and Sealed this

Fifteenth Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,389,549 B2
APPLICATION NO. : 10/949131
DATED : June 24, 2008
INVENTOR(S) : Erich C. Vierkant, III It is certified that error appears in the above-identified patent and that said Letters Patent is hereby corrected as shown below:

In the drawings, delete the second Fig. 6 (the one appearing on the same page as Fig, 7).

Column 6, line 33, claim 6, change [binge] to --hinge--.

This certificate supersedes the Certificate of Correction issued December 15, 2009.

Signed and Sealed this

Twenty-sixth Day of January, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,389,549 B2
APPLICATION NO. : 10/949131
DATED : June 24, 2008
INVENTOR(S) : Erich C. Vierkant, III It is certified that error appears in the above-identified patent and that said Letters Patent is hereby corrected as shown below:

The Title Page, showing an illustrative Figure, should be deleted and substitute therefor the attached title page.

Delete Drawing Sheets 1-6, and substitute therefor the Drawing Sheets, consisting of Figs. 3, 4, 5, 6, 8, and 9, as shown on the attached pages.

Signed and Sealed this

Sixteenth Day of February, 2010

David J. Kappos

David J. Kappos
*Director of the United States Patent and Trademark Office*

(12) United States Patent
Vierkant, III

(10) Patent No.: US 7,389,549 B2
(45) Date of Patent: Jun. 24, 2008

(54) QUICK RELEASE TOILET SEAT HINGE ASSEMBLY

(75) Inventor: Erich C. Vierkant, III, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 313 days.

(21) Appl. No.: 10/949,131

(22) Filed: Sep. 24, 2004

(65) Prior Publication Data

US 2006/0064807 A1 Mar. 30, 2006

(51) Int. Cl.
*A47K 13/12* (2006.01)

(52) U.S. Cl. ..... 4/236; 4/240

(58) Field of Classification Search ..... 4/236, 4/240

See application file for complete search history.

(56) References Cited

U.S. PATENT DOCUMENTS

| | | | | |
|---|---|---|---|---|
| 4,159,548 | A | 7/1979 | Hewson | |
| 4,326,307 | A | 4/1982 | Baillie et al. | |
| 4,939,796 | A | 7/1990 | Pepper | |
| 4,965,889 | A | 10/1990 | Tissot et al. | |
| 5,175,891 | A * | 1/1993 | Ohshima et al. | 4/236 |
| 5,933,875 | A | 8/1999 | Hulsebus et al. | |
| 5,980,150 | A | 11/1999 | Newman et al. | |
| 6,052,869 | A | 4/2000 | Suzuki | |
| 6,070,295 | A | 6/2000 | Hulsebus | |
| 6,381,762 | B1 | 5/2002 | Moser | |
| 6,807,686 | B1 * | 10/2004 | Janes | 4/234 |

FOREIGN PATENT DOCUMENTS

| | | |
|---|---|---|
| FR | 2703579 | 10/1994 |
| GB | 2 280 219 | 1/1995 |
| JP | 10-258003 | 9/1998 |
| JP | 10-258003 | 12/1998 |

* cited by examiner

*Primary Examiner*—Charles E. Phillips
(74) *Attorney, Agent, or Firm*—Quarles & Brady LLP

(57) ABSTRACT

Disclosed is a hinge assembly for connecting a toilet seat and cover to a rearward extension behind a toilet bowl. Two base members are permanently affixed to the extension in spaced fashion. Two hinge support members are provided to snap connect to the base members by virtue of flexible tabs on the base members interconnecting with side wall holes on the hinge supports. The hinge supports, seat and cover can be removed from the extension by squeezing the sides of the hinge support members, leaving only the bases attached to the extension. This facilitates cleaning.

10 Claims, 8 Drawing Sheets

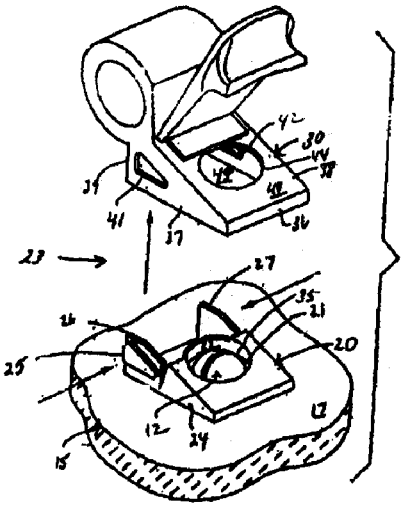

UNITED STATES PATENT AND TRADEMARK OFFICE

CERTIFICATE OF CORRECTION

PATENT NO. : 7,389,549 B2
APPLICATION NO. : 10/949131
DATED : June 24, 2008
INVENTOR(S) : Erich C. Vierkant, III It is certified that error appears in the above-identified patent and that said Letters Patent is hereby corrected as shown below:

This certificate supersedes the Certificate of Correction issued February 16, 2010. The certificate should be vacated since the Certificate of Correction removed drawing sheets from the printed patent in error. There are 8 drawing sheets in printed patent consisting of FIGS. 1-9. The second FIG. 6 is to be deleted (the one appearing on the same page as FIG. 7 in printed patent) The drawing sheets should appear as attached.

Signed and Sealed this

Twenty-third Day of March, 2010

David J. Kappos

David J. Kappos
*Director of the United States Patent and Trademark Office*